US011788371B2

(12) United States Patent
Xie et al.

(10) Patent No.: US 11,788,371 B2
(45) Date of Patent: Oct. 17, 2023

(54) CORING DEVICE

(71) Applicants: SHENZHEN UNIVERSITY, Guangdong (CN); SICHUAN UNIVERSITY, Sichuan (CN)

(72) Inventors: Heping Xie, Sichuan (CN); Mingzhong Gao, Sichuan (CN); Ling Chen, Sichuan (CN); Zhiyi Liao, Sichuan (CN); Zhilong Zhang, Sichuan (CN); Zetian Zhang, Sichuan (CN); Yiqiang Lu, Sichuan (CN); Cong Li, Sichuan (CN); Zhiqiang He, Sichuan (CN)

(73) Assignee: SHENZHEN UNIVERSITY SICHUAN UNIVERSITY, Sichuan (CN)

( * ) Notice: Subject to any disclaimer, the term of this patent is extended or adjusted under 35 U.S.C. 154(b) by 221 days.

(21) Appl. No.: 17/309,232

(22) PCT Filed: Nov. 12, 2018

(86) PCT No.: PCT/CN2018/114966
§ 371 (c)(1),
(2) Date: Mar. 11, 2022

(87) PCT Pub. No.: WO2020/093414
PCT Pub. Date: May 14, 2020

(65) Prior Publication Data

US 2022/0213751 A1 Jul. 7, 2022

(30) Foreign Application Priority Data

Nov. 8, 2018 (CN) ..... 201811336046.5

(51) Int. Cl.
*E21B 25/10* (2006.01)
*E21B 10/02* (2006.01)
(Continued)

(52) U.S. Cl.
CPC ..... *E21B 25/10* (2013.01); *E21B 10/02* (2013.01); *E21B 10/26* (2013.01); *E21B 10/44* (2013.01); *E21B 10/605* (2013.01); *E21B 34/06* (2013.01)

(58) Field of Classification Search
CPC ..... E21B 10/02; E21B 10/26; E21B 10/44; E21B 10/605; E21B 25/08; E21B 25/10; E21B 2200/05; E21B 34/06
See application file for complete search history.

(56) References Cited

U.S. PATENT DOCUMENTS 4,071,099 A * 1/1978 Hensel, Jr. ..... E21B 25/005 73/864.91
4,716,974 A * 1/1988 Radford ..... E21B 25/08 175/59

(Continued)

FOREIGN PATENT DOCUMENTS

CN 101215959 A 7/2008
CN 103775013 A 5/2014

(Continued)

*Primary Examiner* — Taras P Bemko
(74) *Attorney, Agent, or Firm* — NKL Law; Allen Xue

(57) ABSTRACT

A coring device has core drilling tool, a core catcher, a rock core barrel, a drilling machine outer cylinder, a flap valve and an inner rod for pulling the rock core barrel. The core catcher is provided inside the lower end of the rock core barrel. The core drilling tool includes an outer core tube and a hollow drill bit. The upper end of the outer core tube is connected to the lower end of the drilling machine outer cylinder. The lower end of the outer core tube is connected to the drill bit. The lower end of the inner rod protrudes into the rock core barrel and is movable axially by a certain distance relative to the rock core barrel. The flap valve includes a valve seat and a sealing flap. The valve seat is coaxially mounted on the inner wall of the drilling machine outer cylinder.

10 Claims, 20 Drawing Sheets

(51) Int. Cl.

| | |
|---|---|
| ***E21B 10/26*** | (2006.01) |
| ***E21B 10/44*** | (2006.01) |
| ***E21B 10/60*** | (2006.01) |
| ***E21B 34/06*** | (2006.01) |

(56) References Cited

U.S. PATENT DOCUMENTS

| | | | | |
|---|---|---|---|---|
| 6,283,228 | B2 * | 9/2001 | Collee | E21B 25/08 175/58 |
| 8,307,704 | B2 * | 11/2012 | Georgi | G01V 9/00 73/152.07 |
| 9,828,820 | B2 * | 11/2017 | Gupta | G01V 5/04 |
| 2015/0255179 | A1 | 9/2015 | Rosen et al. | |

FOREIGN PATENT DOCUMENTS

| | | | |
|---|---|---|---|
| CN | 106932223 | A | 7/2017 |
| CN | 107130933 | A | 9/2017 |

* cited by examiner

CORING DEVICE

TECHNICAL FIELD

The present invention relates to the technical field of core drilling, and especially to a coring device.

BACKGROUND ART

In the process of oilfield exploration, rock core is the key material for discovering oil and gas reservoir, as well as studying stratum, source rock, reservoir rock, cap rock, structure, and so on. Through the observation and study of the core, the lithology, physical properties, as well as the occurrence and characteristics of oil, gas, and water can be directly understood. After the oilfield is put into development, it is necessary to further study and understand the reservoir sedimentary characteristics, reservoir physical properties, pore structure, wettability, relative permeability, lithofacies characteristics, reservoir physical simulation, and reservoir water flooding law through core. Understanding and mastering the water flooded characteristics of reservoirs in different development stages and water cut stages, and finding out the distribution of remaining oil can provide scientific basis for the design of oilfield development plan, formation system, well pattern adjustment, and infill well.

Coring is to use special coring tools to take underground rocks to the ground in the process of drilling, and this kind of rock is called core. Through it, various properties of rocks can be determined, underground structure and sedimentary environment can be studied intuitively, and fluid properties can be understood, etc. In the process of mineral exploration and development, the drilling work can be carried out according to the geological design of strata and depth, and coring tools were put into the well, to drill out rock samples.

CONTENT OF THE INVENTION

The present invention is intended to provide a coring device, to realize the drilling, grasping and transferring of the core to the coring fidelity cabin.

In order to realize the above objectives, the technical solutions adopted by the present invention are as follows:

A coring device comprises a core drilling tool, a core catcher, a rock core barrel, a drilling machine outer cylinder, a flap valve, and an inner rod for pulling the rock core barrel; the core catcher is provided inside the lower end of the rock core barrel, the core drilling tool includes an outer core tube and a hollow drill bit, the upper end of the outer core tube is connected to the lower end of the drilling machine outer cylinder, and the lower end of the outer core tube is connected to the drill bit; The lower end of the inner rod protrudes into the rock core barrel and is movable axially by a certain distance relative to the rock core barrel, the flap valve comprises a valve seat and a sealing flap, the valve seat is coaxially mounted on the inner wall of the drilling machine outer cylinder, and one end of the sealing flap is movably connected to the outer sidewall of the upper end of the valve seat; the top of the valve seat is provided with a valve port sealing surface matched with the sealing flap;

When the rock core barrel is located in the valve seat, the sealing flap opens 90°; when the rock core barrel is lifted up to a certain height by means of the inner rod, the sealing flap returns to the top surface of the valve seat and is in sealing contact with the sealing surface of the valve opening.

Further, the core catcher comprises an annular base and a plurality of claws, the annular base is coaxially installed on the inner wall of the lower end of the rock core barrel, the claws are evenly arranged on the annular base, the lower end of the claws is connected with the annular base, and the upper end of the claws is retracted inward.

Further, the claw comprises a vertical arm and a tilt arm which are manufactured in one piece, the lower end of the vertical arm is connected with the annular base, the upper end of the vertical arm is connected with the lower end of the tilt arm, the upper end of the tilt arm is a free end, and the tilt arm tilts inward from bottom to top.

Further, the drill bit comprises an inner drill bit and an outer drill bit, the inner drill bit is installed in the outer drill bit, the lower end of the inner drill bit is provided with a first stage blade for drilling, and the outer sidewall of the outer drill bit is provided with a second stage blade for reaming.

Further, a spiral groove is arranged on the outer wall of the outer core tube and the outer drill bit, and the spiral groove on the outer drill bit is continuous with the spiral groove on the outer core tube.

Further, the first stage blade and the second stage blade on the drill bit are provided with coolant circuit holes.

Further, the rock core device also includes a trigger mechanism, that includes a trigger inner barrel and a trigger block. The side wall of the trigger inner barrel is provided with a through hole, the trigger block is placed in the through hole, and the outer sidewall of the bottom of the rock core barrel is provided with a convex part adapted to the trigger block. The inner wall of the drilling machine outer barrel is provided with a recessed opening which is matched with the trigger block.

The trigger block is located above the sealing valve flap, and the recessed opening is located above the trigger block;

When the rock core barrel is located in the valve seat, the inner trigger barrel is located between the rock core barrel and the drilling machine outer cylinder, the lower end of the inner trigger barrel is matched with the valve seat stop, the trigger block protrudes from the inner sidewall of the inner trigger barrel, and the sealing valve flap is located between the inner trigger barrel and the drilling machine outer cylinder. When the rock core barrel is raised to a certain height, the sealing flap returns to the top surface of the valve seat and is in sealing contact with the sealing surface of the valve opening, and the bottom of the trigger inner barrel presses on the sealing flap.

Preferably, the trigger mechanism also includes a trigger spring, that is sleeved outside the trigger inner barrel; the outer wall of the trigger inner barrel is provided with a shoulder, the lower end of the trigger spring is pressed against the shoulder, and the upper end of the trigger spring is pressed against the step surface of the drilling machine outer cylinder; the trigger spring is located above the trigger block.

Wherein, the outer sidewall of the lower part of the inner rod is provided with a limit step 1, while the inner sidewall of the upper part of the rock core barrel is provided with a limit step 2 adapted to the limit step 1. When the limit step 1 and the limit step 2 are against each other, the rock core barrel and the inner rod can no longer move axially.

Further, the bottom of the inner rod expands, and the outer wall of the expanding part of the inner rod is provided with a sealing ring 1, which plays a sealing role with the inner wall of the rock core barrel.

Compared with the prior art, the present invention has the following beneficial effects:

1. The present invention can realize the core drilling, grasping and transferring to the coring fidelity cabin through the mutual cooperation of various parts, and can complete the core drilling with high stability, high performance, and high efficiency;

2. In the present invention, the drill bit is divided into two-stage blades, the bottom blade drills a small hole first, and then the upper blade expands the hole, so as to improve the drilling speed and the coring efficiency. The carbide sharp thin bit is used to cut the rock stratum, to reduce the disturbance of coring process to the formation and ensure the integrity and quality of coring;
3. A through hole is provided in the blade part as a coolant circuit hole, and the coolant can be sprayed out through the through hole to cool the blade, speed up the cooling rate of the blade, reduce the wear of the tool, and extend the life of the blade;
4. The outer wall of the outer core tube is provided with a spiral groove continuous with the drill bit, and as the outer core tube is screwed into the rock formation, the outer core tube creates a closed space for the coring tool, which can prevent the fidelity cabin from being contaminated;
5. In the present invention, the core catcher is a mechanical claw that faces upwards and is folded inward. When the claws go down, the claws are easily propped up by the core, so that the core enters the inner barrel; when the claws go up, it is difficult for claws to be stretched by the rock core, and because the rock core cannot resist the greater pulling force and the clamping action of the claws, the rock core is broken at the claws, and the broken core will continue to move up with the claws and remain in the inner barrel. The core catcher according to the present invention is easy to pull off hard rock, and solves the technical problem that the core catcher in the prior art can only take soft rock and is difficult to take hard rock;
6. When the flap valve is closed, the sealing flap is pressed by the falling trigger inner barrel, and the sealing-specific pressure is large, which can further improve the sealing performance of the valve.

Figure 1:
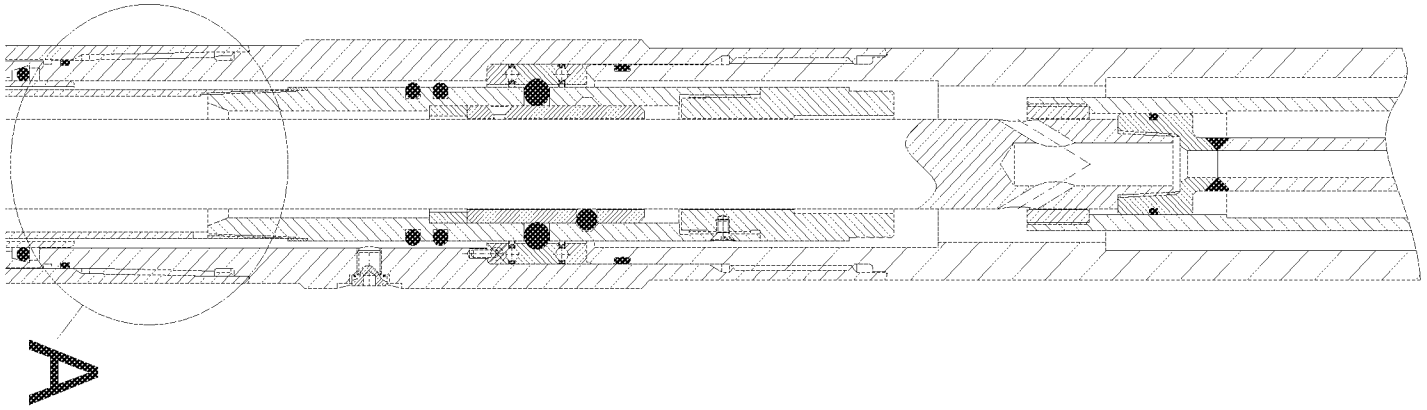
FIG. 1. Schematic diagram of the present invention before coring.
Figure 1:
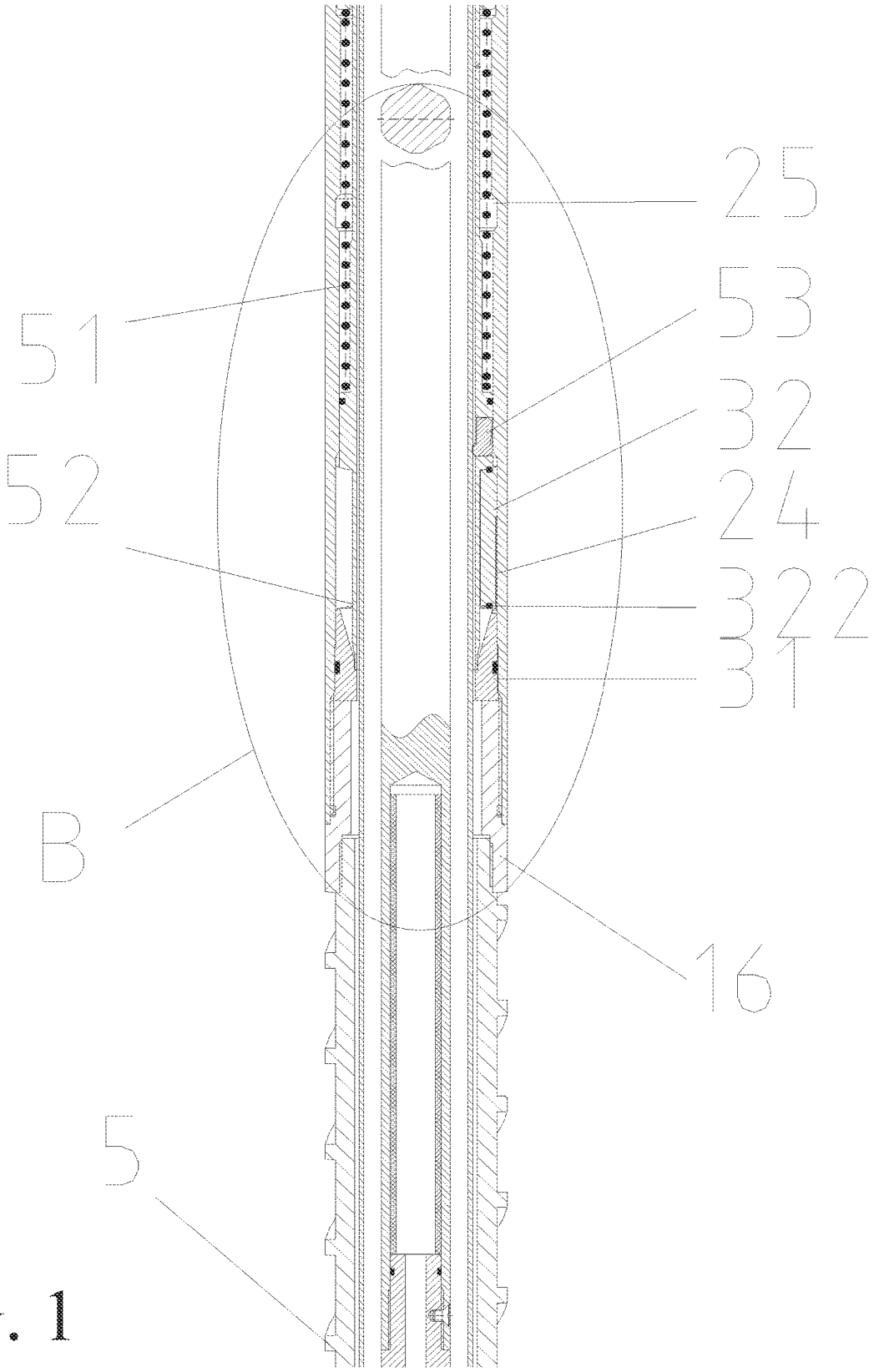
Figure 1:
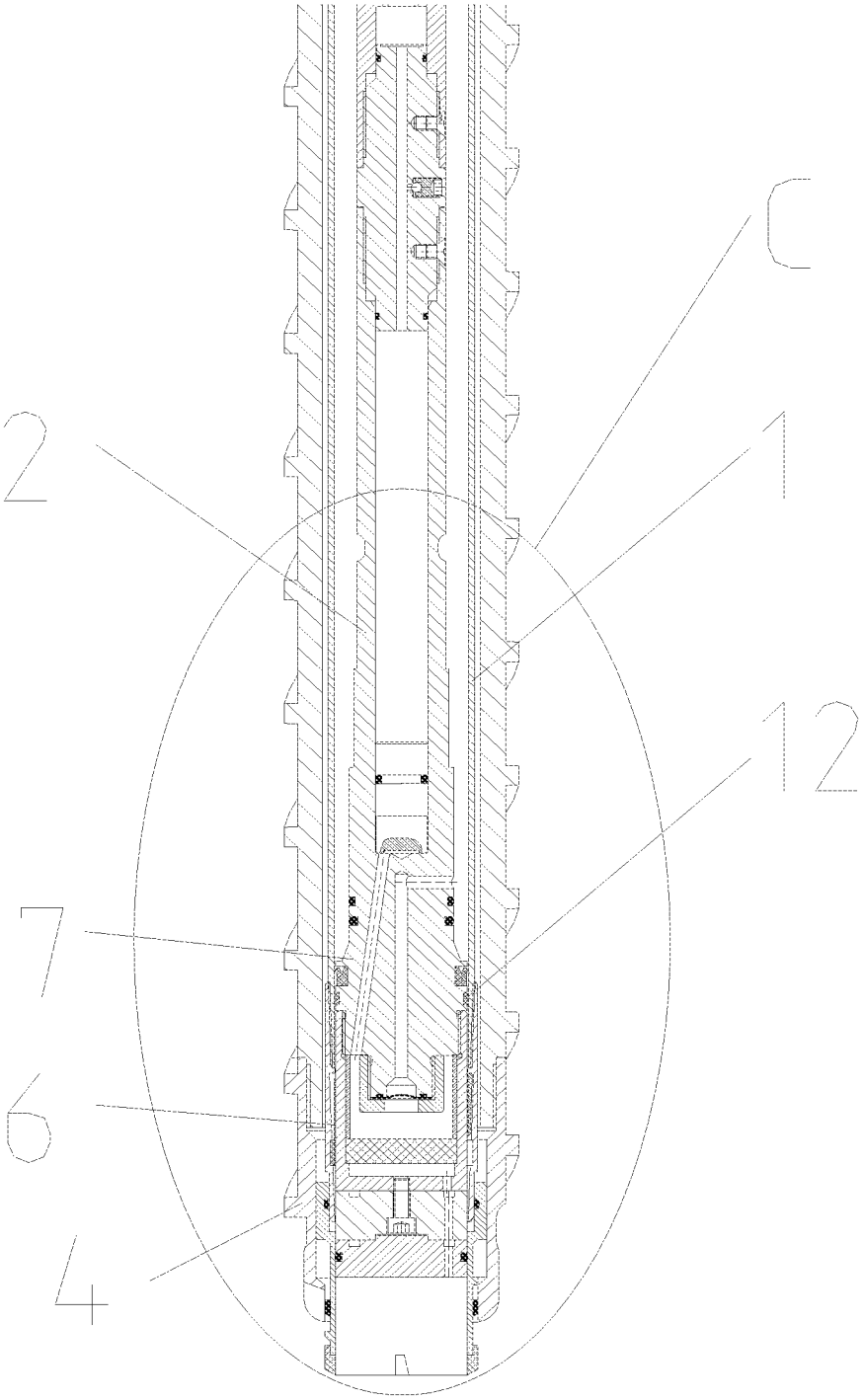
Figure 2:
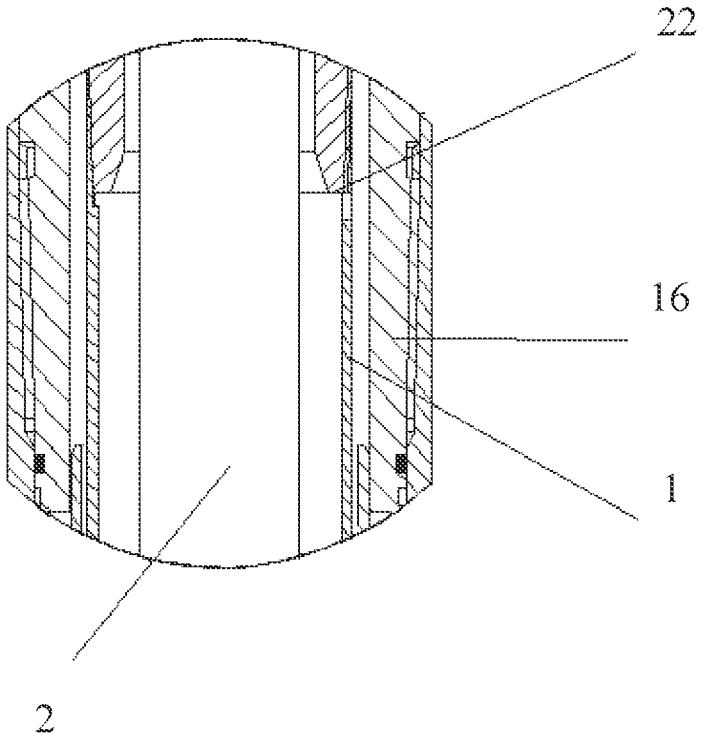
FIG. 2. An enlarged view of A in FIG. 1.
Figure 3:
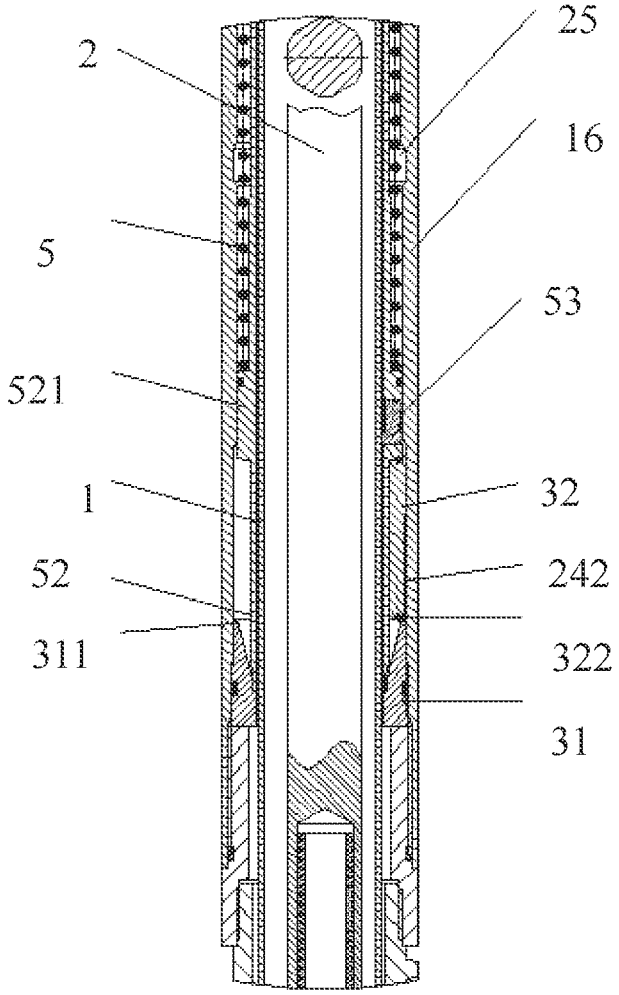
FIG. 3. An enlarged view of B in FIG. 1.

In Figures: 1—rock core barrel, 2—inner rod, 3—flap valve, 4—drill bit, 5—outer core tube, 6—core catcher, 7—expand, 8—sealing ring 2, 9—coolant circuit hole, 10—spiral groove, 11—convex part, 12—sealing ring 1, 16—drilling machine outer cylinder, 21—limt step 1, 22—limt step 2, 24—spring sheet, 25—recessed opening, 31—valve seat, 32—sealing flat, 41—inner drill bit, 42—outer drill bit, 51—trigger spring, 52—trigger inner barrel, 53—trigger block, 61—annular base, 62—claws, 63—ring sleeve, 121—vertical arm, 122—tilt arm, 241—shaft, 242—spring sheet, 311—valve port sealing surface, 321—groove, 322—sealing ring 3, 411—the first stage blade, 412—inner drill body, 413—the first stage blade installation slot, 421—the second stage blade, 422—outer drill body, 423—the second stage blade installation groove, 424—the first stage blade avoidance notch, 521—shoulder.

EXAMPLES

In order to make the objectives, technical solutions, and advantages of the present invention clearer, the present invention will be further illustrated hereinafter by combing with the attached Figures.

As shown in FIGS. 1-16, the coring device disclosed in the present invention comprises a core drilling tool, a rock core barrel 1, a core catcher 6, a drilling machine outer cylinder 16, a flap valve 3, and an inner rod 2 for pulling the rock core barrel 1; the core catcher 6 is provided inside the lower end of the rock core barrel 1, the core drilling tool comprises an outer core tube 5 and a hollow drill bit 4, the upper end of the outer core tube 5 is connected to the lower end of the drilling machine outer cylinder 16, and the lower end of the outer core tube 5 is connected to the drill bit 4.

The lower end of the inner rod 2 protrudes into the rock core barrel 1 and is movable axially by a certain distance relative to the rock core barrel 1. The bottom of the inner rod 2 is enlarged, and the outer wall of the enlarged portion 7 of the inner rod 2 is provided with a sealing ring 1 12, which is in sealing engagement with the inner wall of the rock core barrel 1. The lower outer sidewall of the inner rod 2 is provided with a limit step 1 21, and the upper inner sidewall of the rock core barrel 1 is provided with a limit step 2 22 adapted to the limit step 1 21. When the limit step 1 21 and the limit step 2 22 are against each other, the rock core barrel 1 and the inner rod 2 can no longer move axially.

Figure 11:
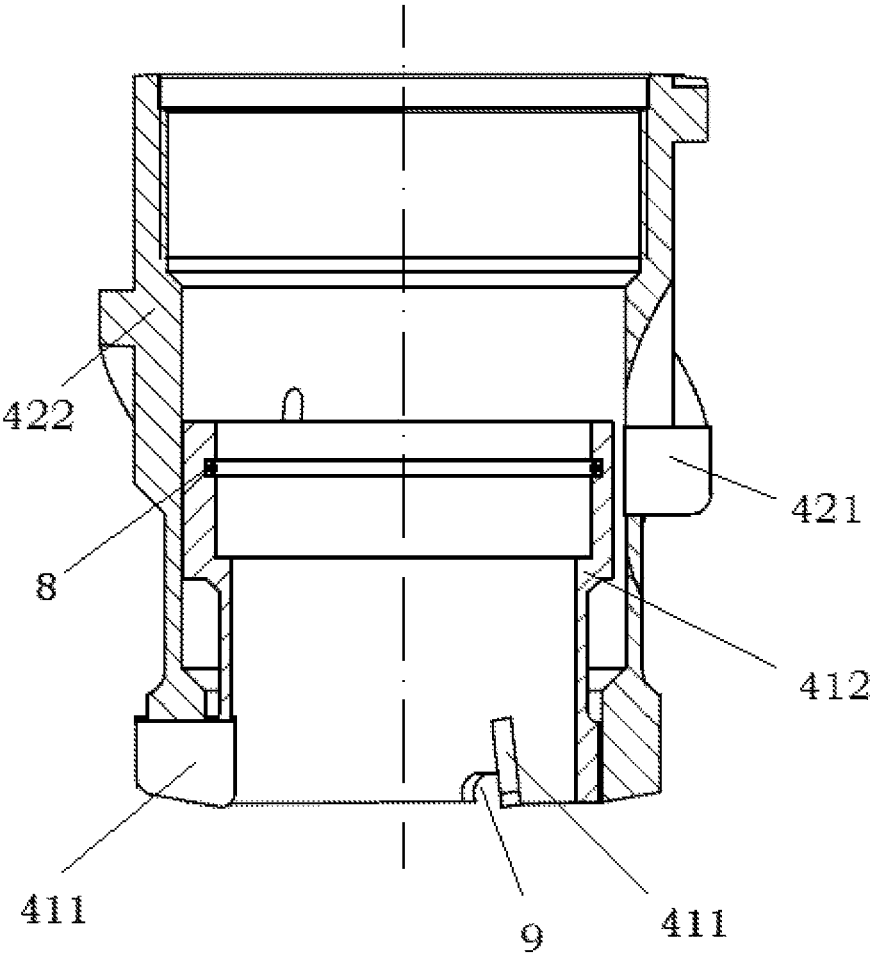
FIG. 11. Sectional view of the drill bit.
Figure 12:
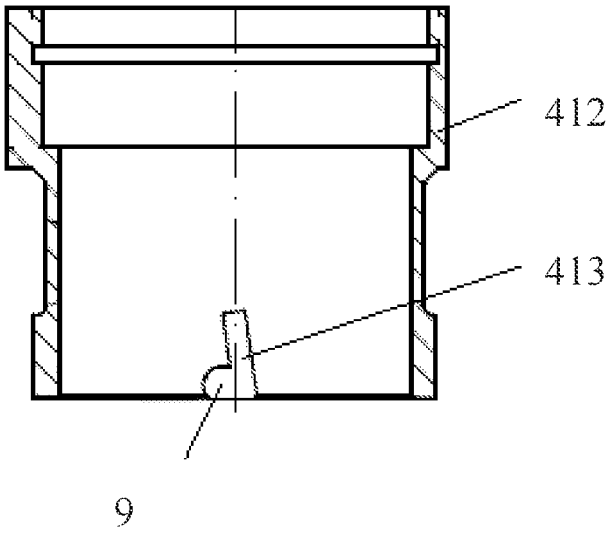
FIG. 12. Schematic diagram of the structure of the inner drill body.
Figure 13:
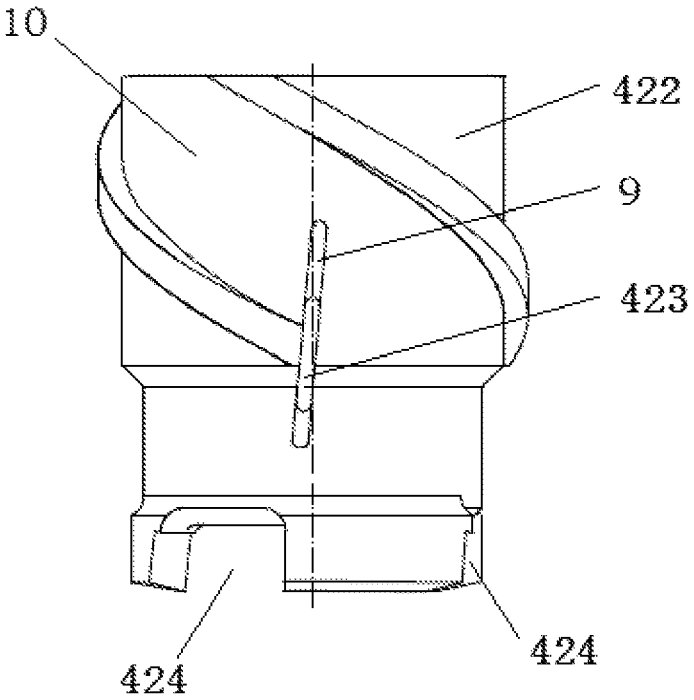
FIG. 13. Schematic diagram of the structure of the outer drill body.

In this specific example, the drill bit 4 is a PCD tool. As shown in FIGS. 11, 12 and 13, the drill bit 4 includes an inner drill bit 41 and an outer drill bit 42, and the inner drill bit 41 includes a first-stage blade 411 and a hollow inner drill body 412. The outer drill bit 42 includes a second-stage blade 421 and a hollow outer drill body 422. As shown in FIGS. 11 and 12, the lower end of the inner drill body 412 is provided with a first-stage blade installation groove 413 for installing the first-stage blade 411. The first-stage blade installation groove 413 is opened on the lower end surface of the inner drill body 412, on which the first stage blade installation groove 413 is provided with a coolant circuit hole 9 that is an arc-shaped hole. The arc-shaped hole opens on the front end surface of the drill bit 4 and communicates with the first-stage blade installation groove 413. The inner drill body 412 is provided with three first-level blade mounting grooves 413 at equal intervals in the circumferential direction, each first-level blade mounting groove 413 is provided with a coolant circuit hole 9, and a first-stage blade 411 is installed in each first-level blade mounting groove 413.

As shown in FIGS. 11 and 13, the outer wall of the outer drill body 422 is provided with a second-stage blade installation groove 423 for installing the second-stage blade 421, and the second-stage blade installation groove 423 on the outer drill body 422 is provided with a coolant circuit hole 9, the coolant circuit hole 9 is a bar-shaped hole, and the bar-shaped hole communicates with the second-stage blade installation groove 423. The outer drill body 422 is provided with three second-level blade installation grooves 423 at equal intervals in the circumferential direction, and each second-level blade installation groove 423 is provided with a coolant circuit hole 9, and a second-level blade 421 is installed in each second-level blade installation groove 423.

As shown in FIGS. 11, 12, and 13, the inner drill 41 is installed inside the outer drill 42, and the outer drill body 422 has a first-stage blade avoidance notch 424 at a position corresponding to the first-stage blade 411. The first-stage blade avoidance notch 424 opens on the front end of the outer drill 42. The cutting edge of the first-stage blade 411 is exposed from the outer drill body 422 by the first-stage blade avoidance notch 424. The inner wall of the inner drill body 412 is provided with a second seal ring 8, and the second seal ring 8 is located above the first-stage blade 411. The second seal ring 8 is a highly elastic annular sealing ring. In the present invention, the drill bit is divided into two-stage blades. The first-stage blade 411 at the lower end first drills small holes, and then the second-stage blade 421 at the upper reams the hole, which can increase the drilling speed. A through hole is provided at the blade position as a cooling liquid circuit hole 9, through which cooling liquid can be sprayed to cool the blade.

Figure 4:
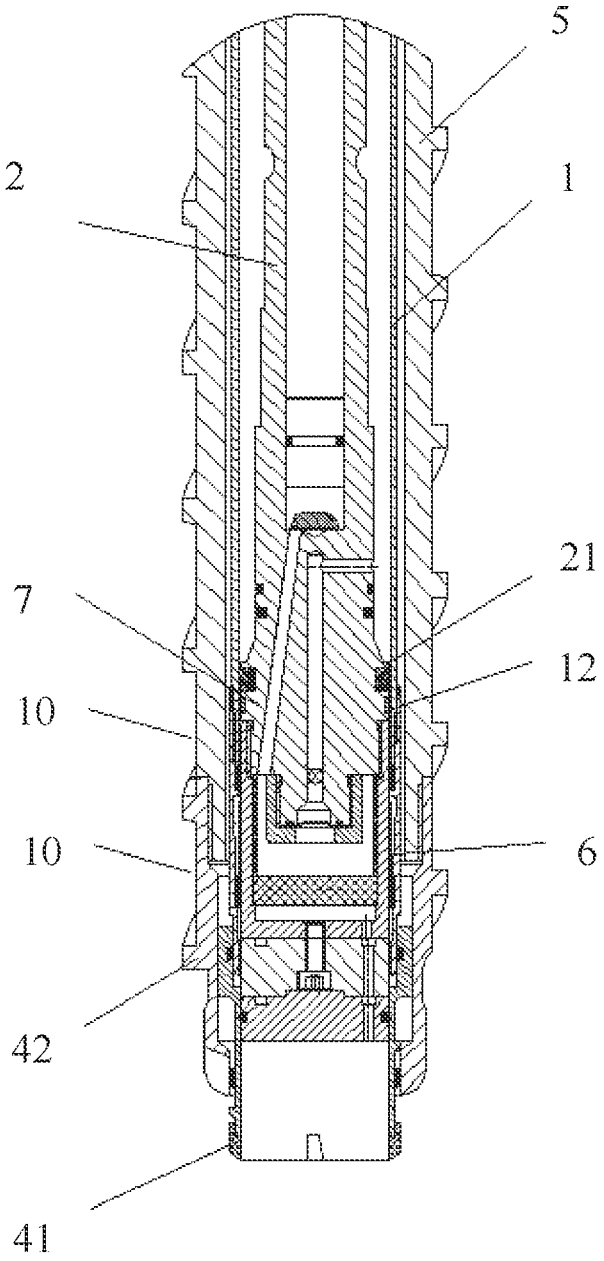
FIG. 4. An enlarged view of C in FIG. 1.
Figure 5:
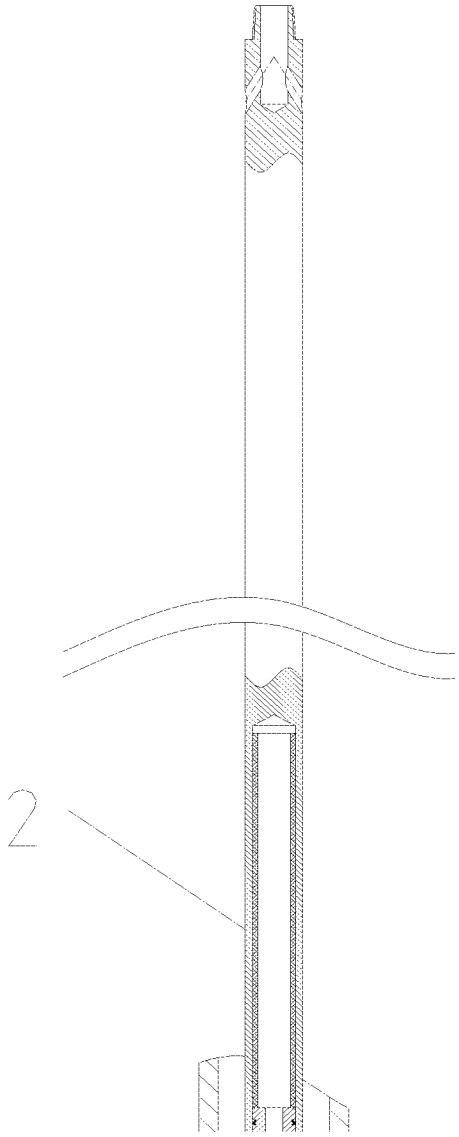
FIG. 5. Schematic diagram of the present invention during coring.
Figure 5:
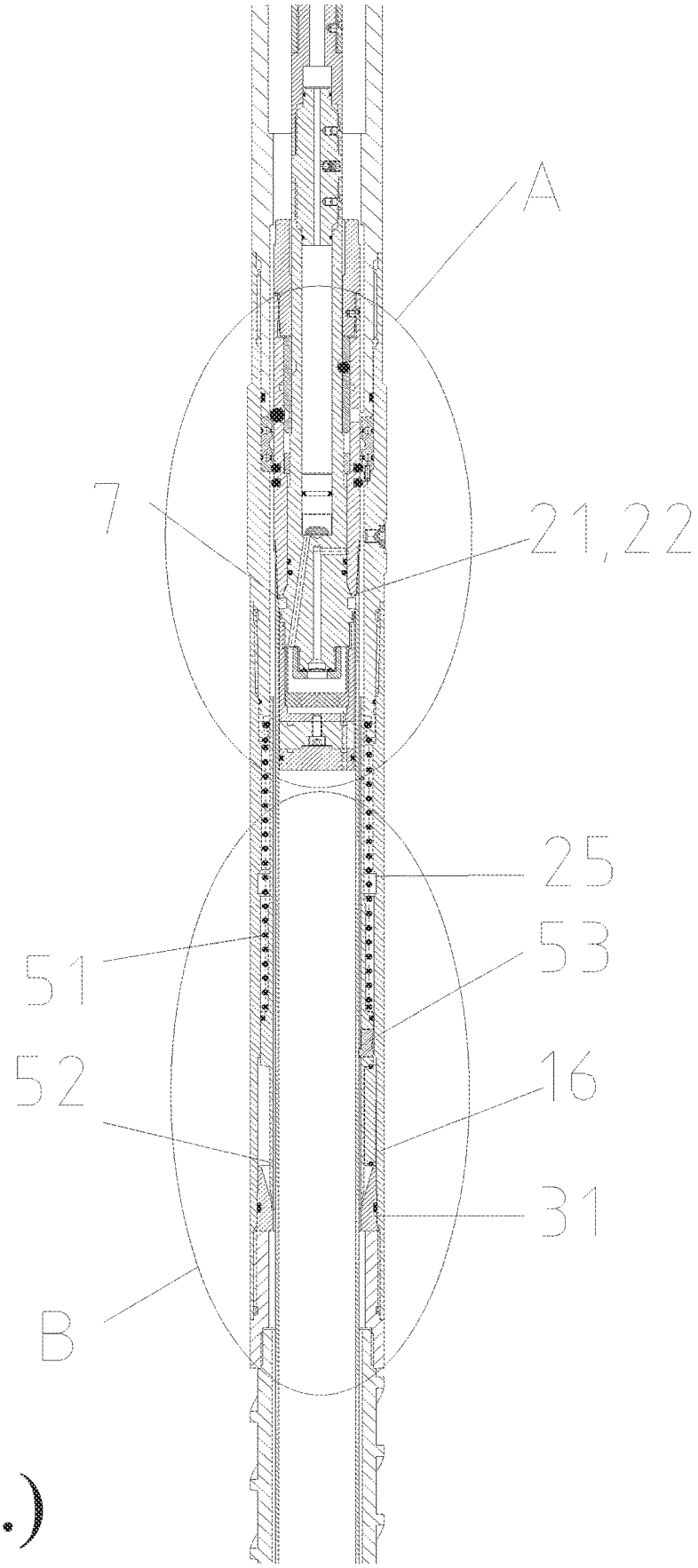
Figure 5:
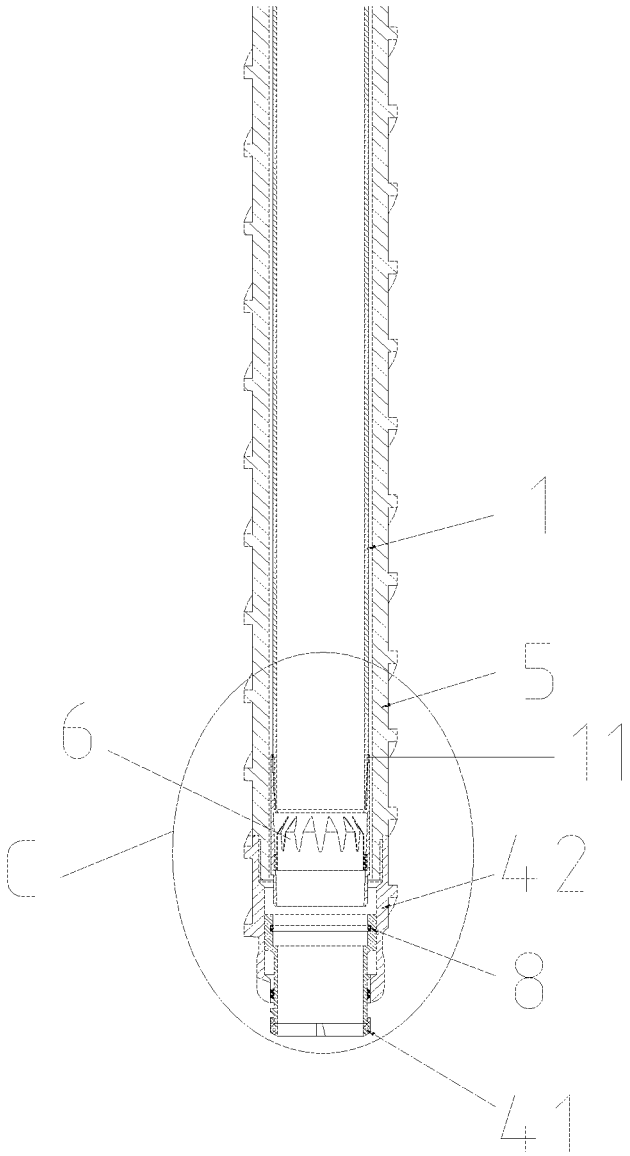
Figure 6:
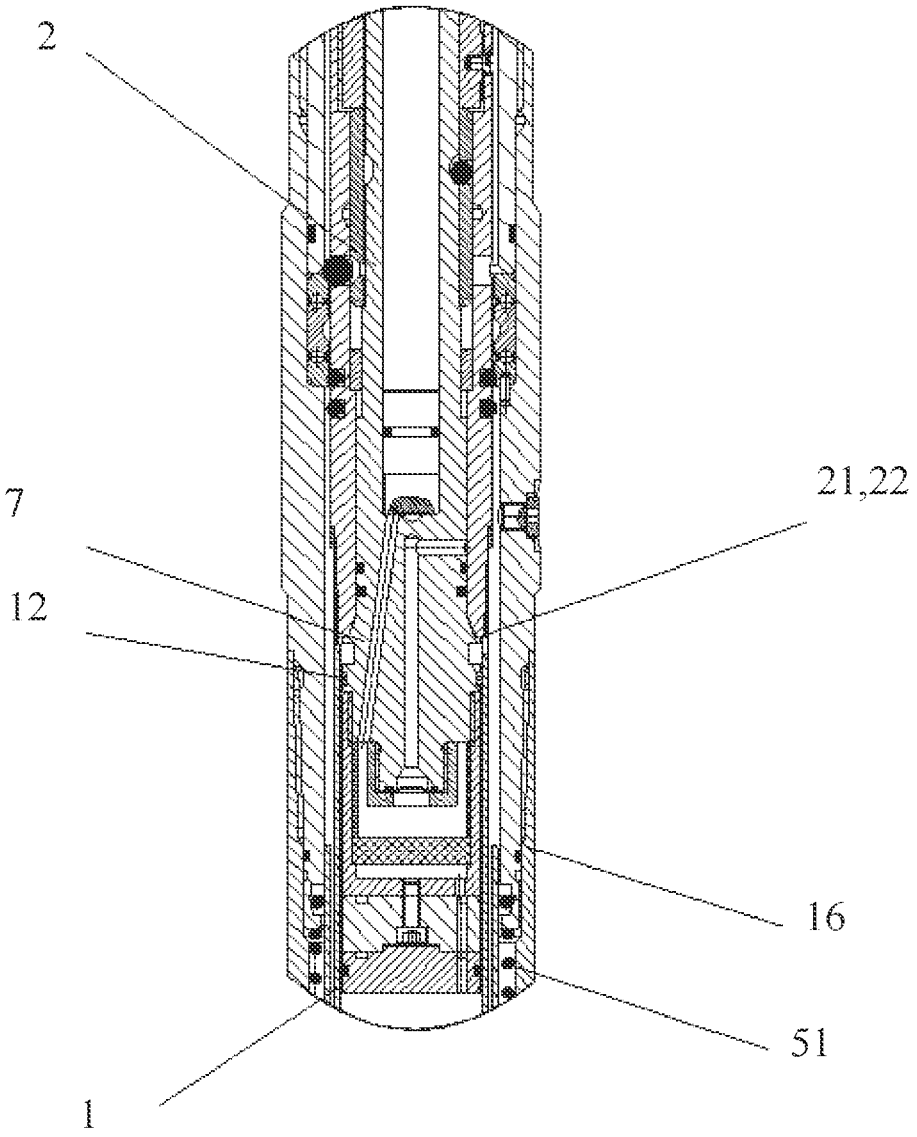
FIG. 6. An enlarged view of A in FIG. 5.
Figure 7:
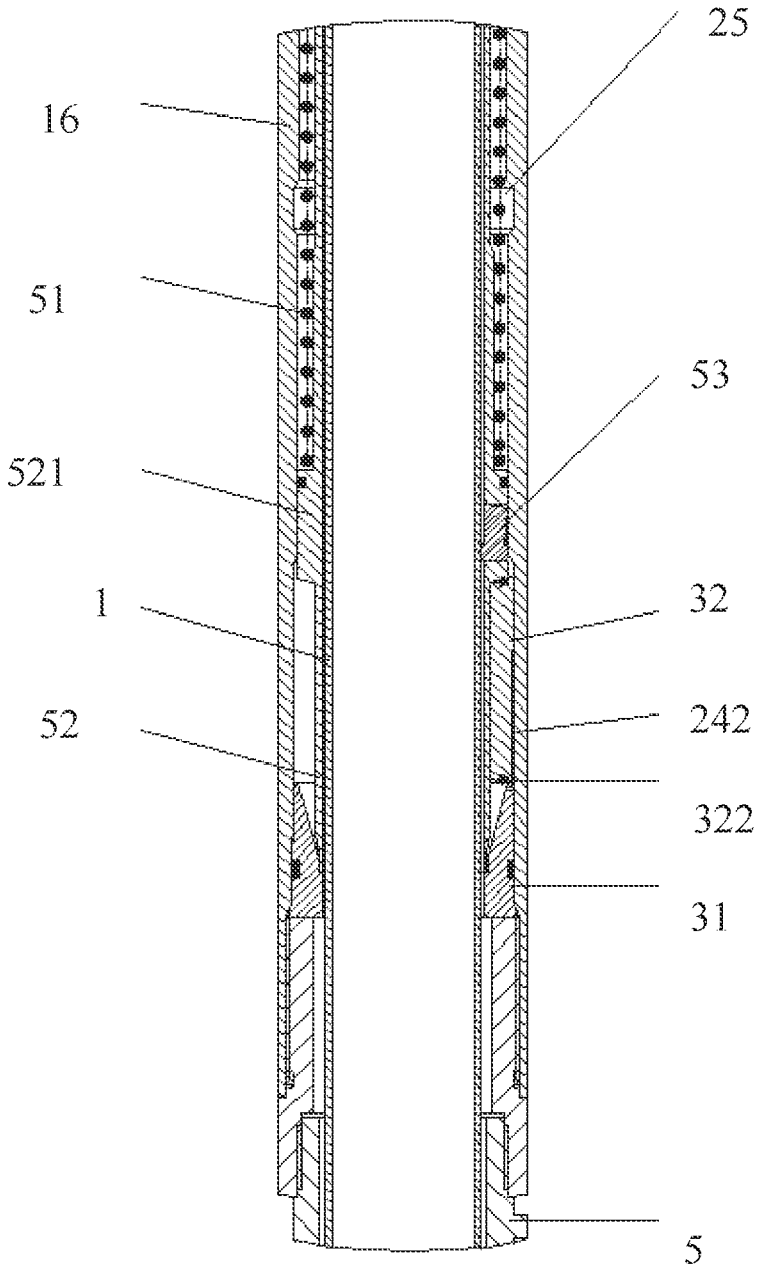
FIG. 7. An enlarged view of B in FIG. 5.
Figure 8:
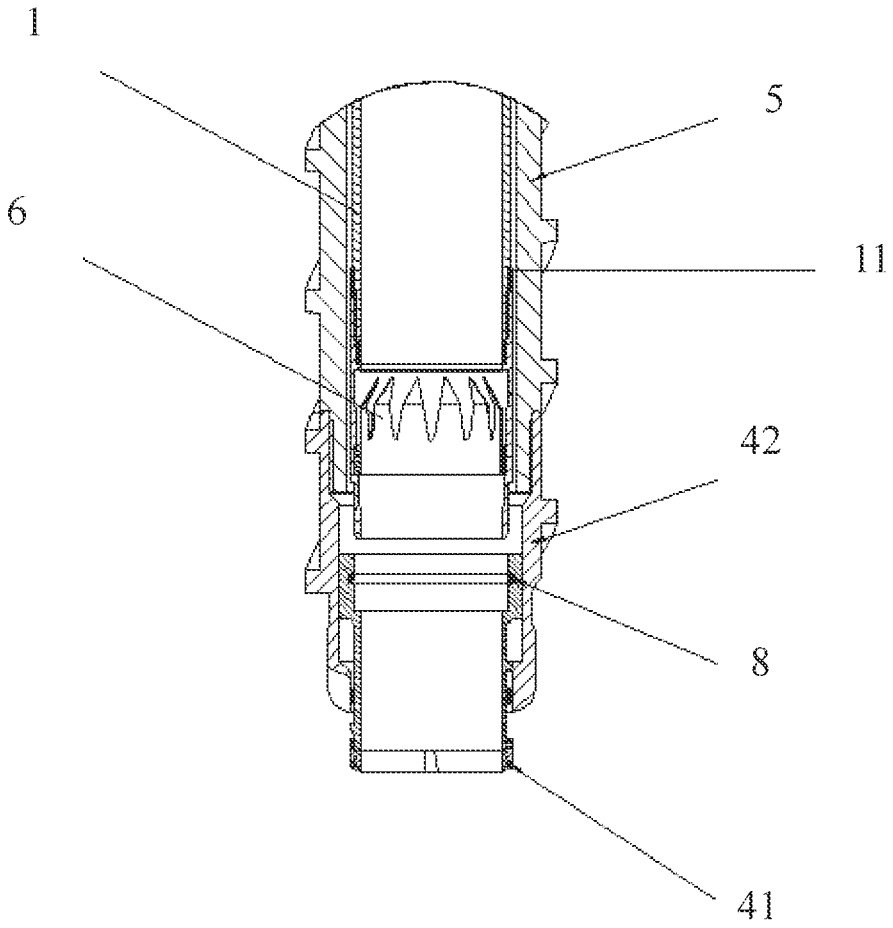
FIG. 8. An enlarged view of C in FIG. 5.

As shown in FIGS. 4 and 13, both the outer core tube 5 and the outer wall of the outer drill body 422 are provided with spiral grooves 10, and the spiral groove 10 on the outer drill body 422 is continuous with the spiral groove 10 on the outer core tube 5. The outer core tube 5 with the spiral groove 10 on the outer wall is equivalent to a spiral outer drill. As the outer core tube 5 is screwed into the rock formation, the outer core tube 5 creates a closed space for the coring tool. During the coring process, the second sealing ring 8 wraps the core, to ensure the isolation and quality preservation effect and achieve the goal of moisturizing and quality preservation. The present invention uses a hard alloy sharp thin bit to cut the rock formation, reduces the disturbance to the formation during the coring process, and ensures the integrity and quality of the coring.

Figure 14:
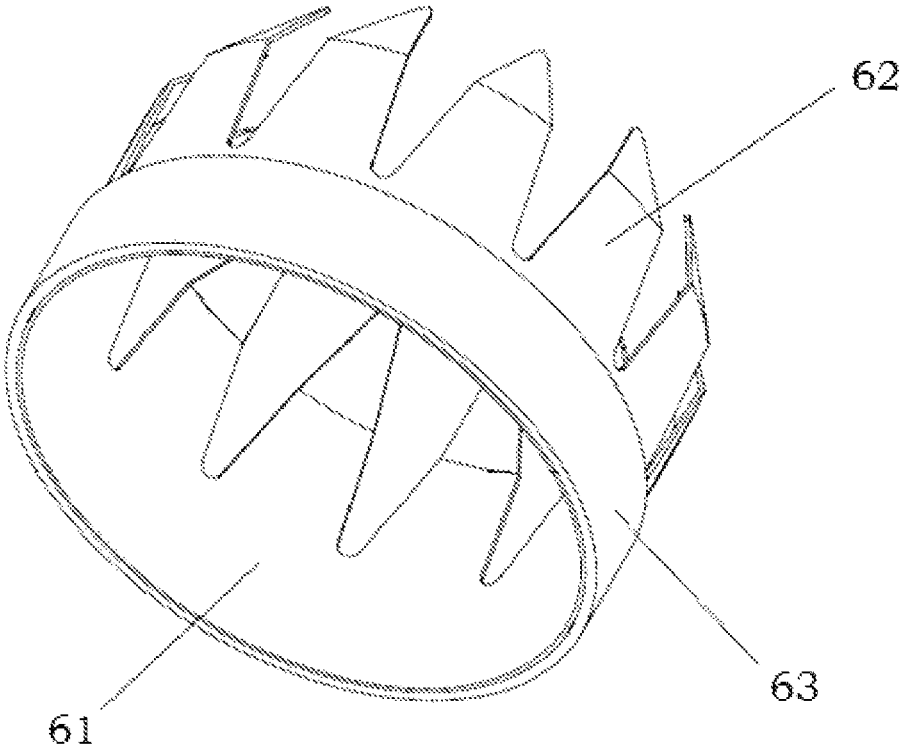
FIG. 14. 3D drawing of the core catcher.
Figure 15:
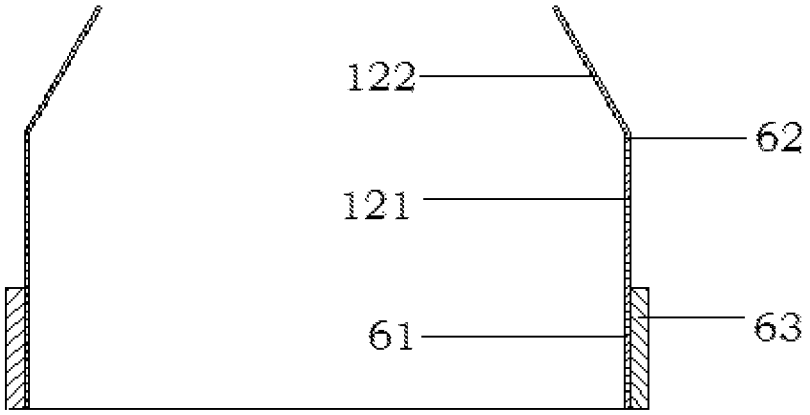
FIG. 15. Sectional view of the core catcher.
Figure 16:
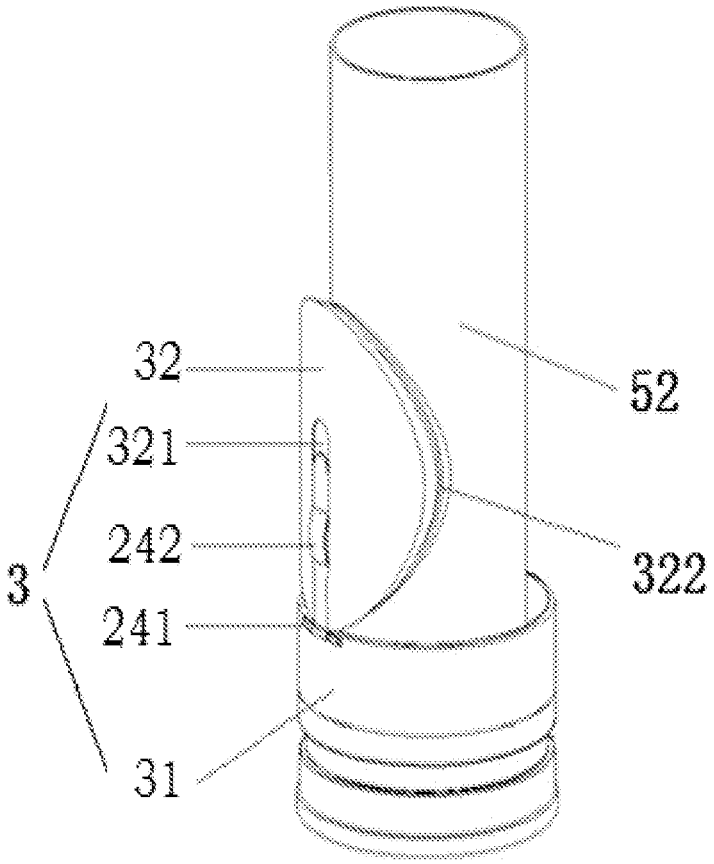
FIG. 16. Schematic diagram of the flap valve.

As shown in FIGS. 14 and 15, the core catcher 6 includes an annular base 61 and a plurality of claws 62. The claws 62 are evenly arranged on the annular base 61. The lower ends of the claws 62 are connected with the annular base 61, while the upper ends of the claws 62 are folded inward. There are 8~15 claws 62, preferably 12 claws 62. The number of claws 62 can be set as required, and is not limited to those listed above.

The claw 62 includes integrally manufactured vertical arm 121 and tilt arm 122. The lower end of the vertical arm 121 is connected with the annular base 61, while the upper end of the vertical arm 121 is connected with the lower end of the tilt arm 122, and the upper end of the tilt arm 122 is a free end. The tilt arm 122 is inclined inward from bottom to top, and the inclination of the tilt arm 122 can be adjusted as required. In this example, the tilt angle of the tilt arm 122 is 60°, and the width of the claw 62 gradually decreases from bottom to top.

Wherein, the thickness of the pawl 62 is equal to the thickness of the annular base 61, and the pawl 62 is manufactured integrally with the annular base 61. The annular base 61 is sheathed with an annular sleeve 63, and both of annular base 61 and annular sleeve 63 are fixedly connected.

In particular, an annular groove adapted to the annular sleeve 63 is provided on the inner wall of the rock core barrel 1, and the annular sleeve 63 is embedded in the annular groove with the free end of the claw 62 facing upward, and the free end of the claw 62 facing upward and inward. When the rock core passes through the hard claw 62 from bottom to top, it is easy to be stretched, while it is hard to be stretched when passing from top to bottom.

As shown in FIGS. 3, 7, 10, and 16, the flap valve 3 includes a valve seat 31 and a sealing valve flap 32. The valve seat 31 is coaxially mounted on the inner wall of the drilling machine outer cylinder 16. A sealing ring is arranged between the outer wall of the valve seat 31 and the inner wall of the drilling machine outer cylinder 16, and the sealing ring is mounted on the outer wall of the valve seat 31. One end of the sealing flap 32 is movably connected with the outer side wall of the upper end of the valve seat 31, and the top of the valve seat 31 has a valve port sealing surface 311 matching the sealing flap 32. When the rock core barrel 1 is located in the valve seat 31, the sealing flap 32 is opened 90° and located between the rock core barrel 1 and the drilling machine outer cylinder 16. When the rock core barrel 1 is lifted up to a certain height by the inner rod 2, the sealing flap 32 returns to the top surface of the valve seat 31, and is in a sealing contact with the valve port sealing surface 311.

The outer periphery of the sealing flap 32 is provided with an annular groove for installing the third sealing ring 322, and the third sealing ring 322 is installed in the annular groove. In the specific example, one end of the sealing flap 32 is hinged with the outer sidewall of the upper end of the valve seat 31 through the spring sheet 24, in which the spring sheet 24 includes a rotating shaft 241 and an elastic sheet 242. The top of the side wall of the valve seat 31 has a rotating shaft accommodating groove adapted to the rotating shaft 241, and the outer surface of the sealing flap 32 has a groove 321 for receiving the elastic sheet 242. The elastic sheet 242 is a curved steel sheet, which is stuck in the groove 321, and the curved steel sheet can be straightened under the action of external force, and its curved surface can be turned into a plane and completely fit with the groove 321 on the outer surface of the sealing flap 32. When the sealing flap 32 is opened by 90°, the inner surface of the sealing flap 32 and the outer wall of the trigger inner barrel 52 are a complete fit, moreover, the outer surface and the outer sidewall of the valve seat 31 are in the same cylindrical surface. The sealing flap 32 is a spatial curved surface obtained by cutting a semicircular tube piece with a conical surface or a spherical surface, and the outer diameter of the semicircular tube piece is consistent with the outer diameter of the valve seat 31.

In another example, the sealing flap 32 is hinged with the outer sidewall of the upper end of the valve seat 31 through a pin shaft and a torsion spring.

In order to increase the sealing-specific pressure, the coring device also includes a trigger mechanism, that includes a trigger inner barrel 52, a trigger spring 51, and a trigger block 53. A through hole is provided on the side wall of the trigger inner barrel 52, and the trigger block 53 is placed in the through hole. The outer sidewall at the bottom of the rock core barrel 1 has a convex part 11 that fits with the trigger block 53. The inner wall of the drilling machine outer cylinder 16 has a recessed opening 24 adapted to the trigger block 53. The trigger block 53 is located above the sealing flap 32, and the recessed opening 24 is located above the trigger block 53; the trigger spring 51 is sleeved outside the trigger inner barrel 52, and the outer wall of trigger inner barrel 52 is provided with a shoulder 521. The lower end of the trigger spring 51 is pressed against the shoulder 521, while the upper end of the trigger spring 51 is pressed against the step surface of the drilling machine outer cylinder 16, and the trigger spring 51 is located above the trigger block 53.

As shown in FIGS. 1, 3, 5, and 7, when the rock core barrel 1 is located in the valve seat 31, the trigger inner barrel 52 is located between the rock core barrel 1 and the drilling machine outer cylinder 16. The lower end of the trigger inner barrel 52 matches the stop of the valve seat 31, and the trigger block 53 protrudes outside from the inner side wall of the trigger inner barrel 52. The outside of the trigger block 53 is in contact with the inner wall of the drilling machine outer cylinder 16, while the inside of the trigger block 53 is in contact with the outer wall of the rock core barrel 1. The sealing flap 32 is opened by 90° and is located between the inner trigger barrel 52 and the drilling machine outer cylinder 16.

Figure 9:
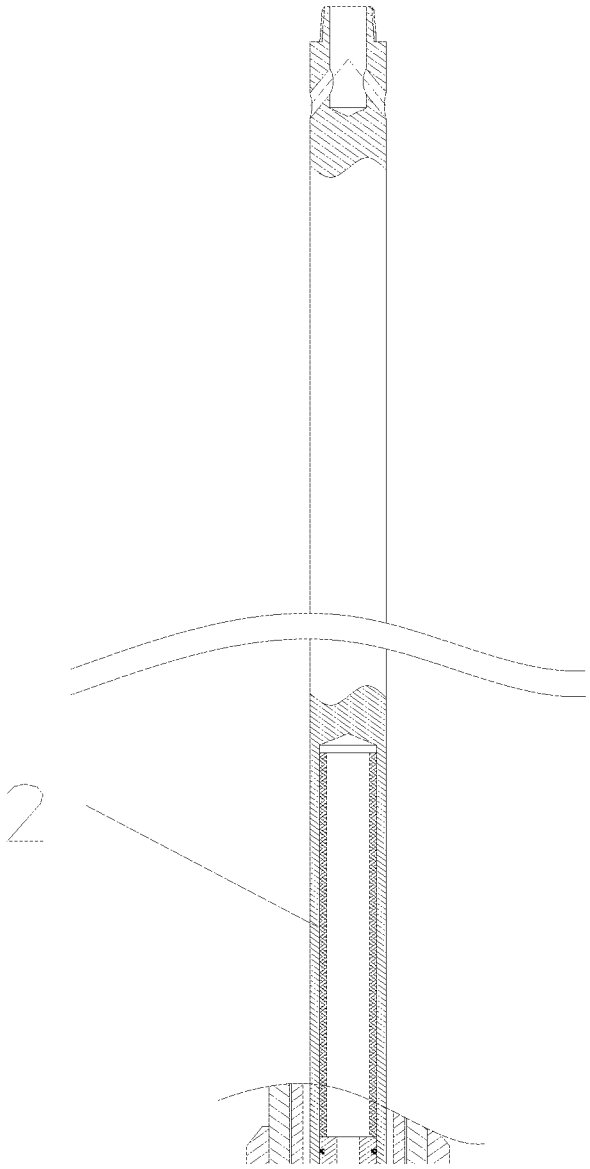
FIG. 9. Schematic diagram of the present invention after coring is completed.
Figure 9:
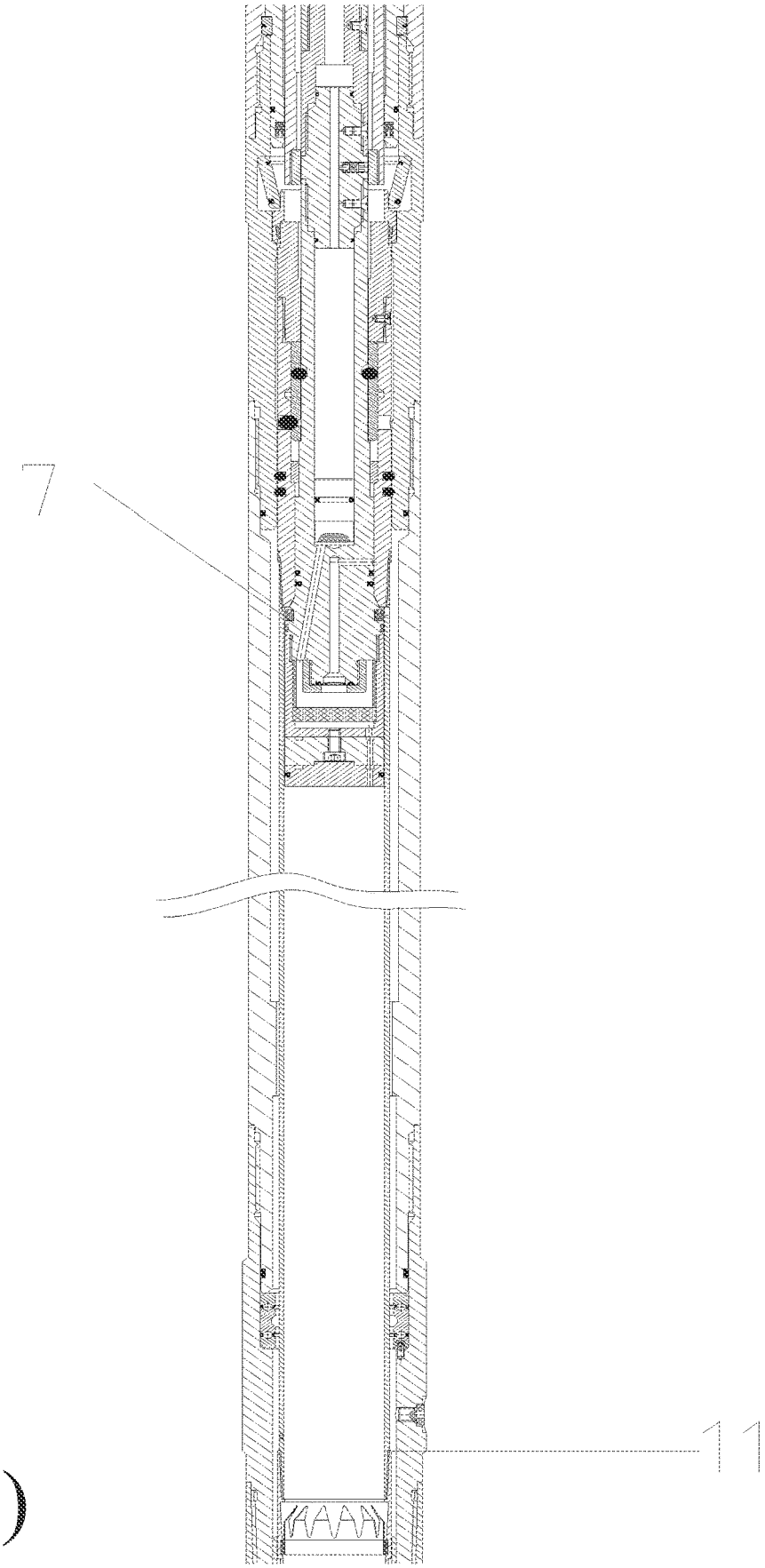
Figure 9:
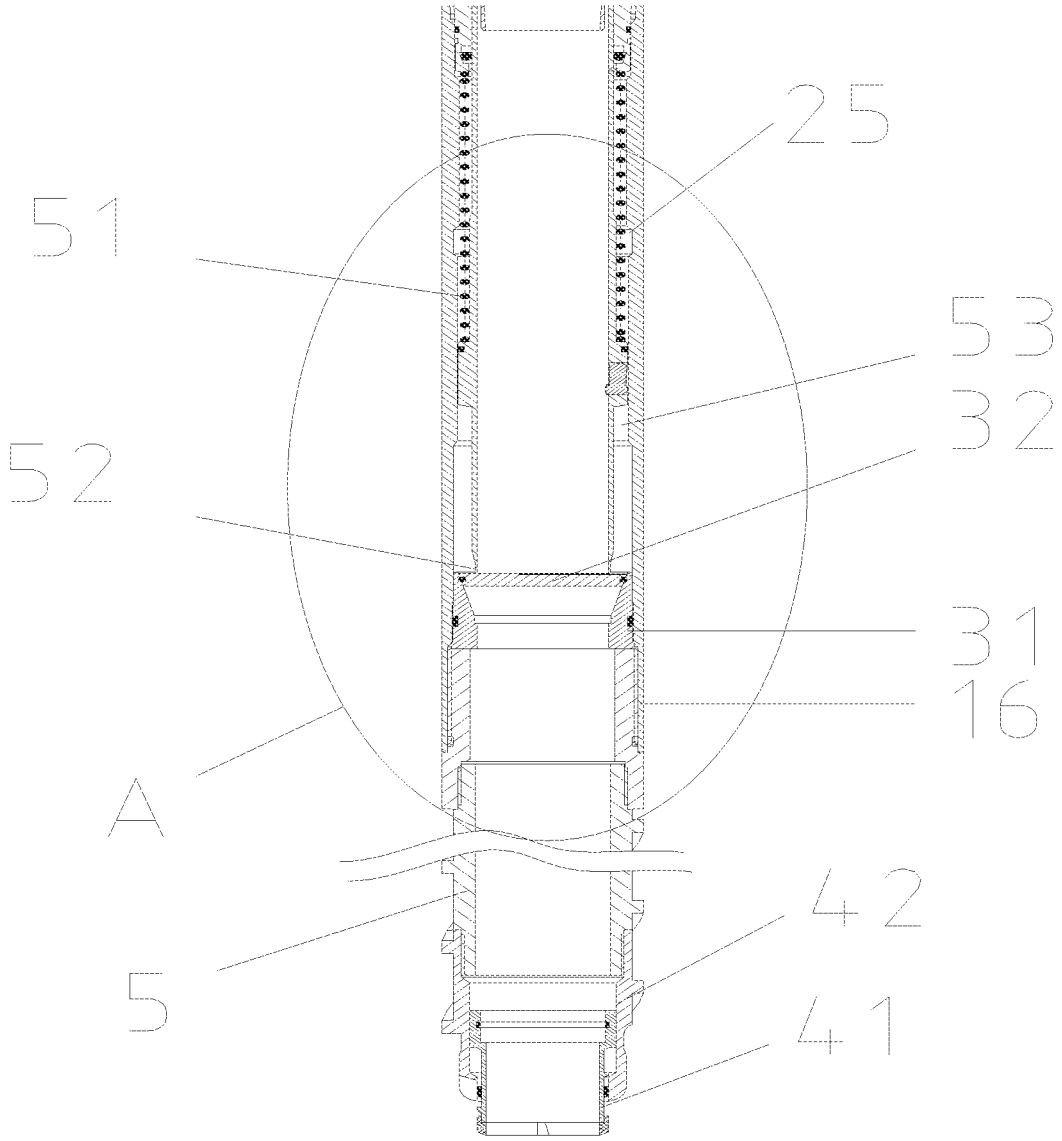
Figure 10:
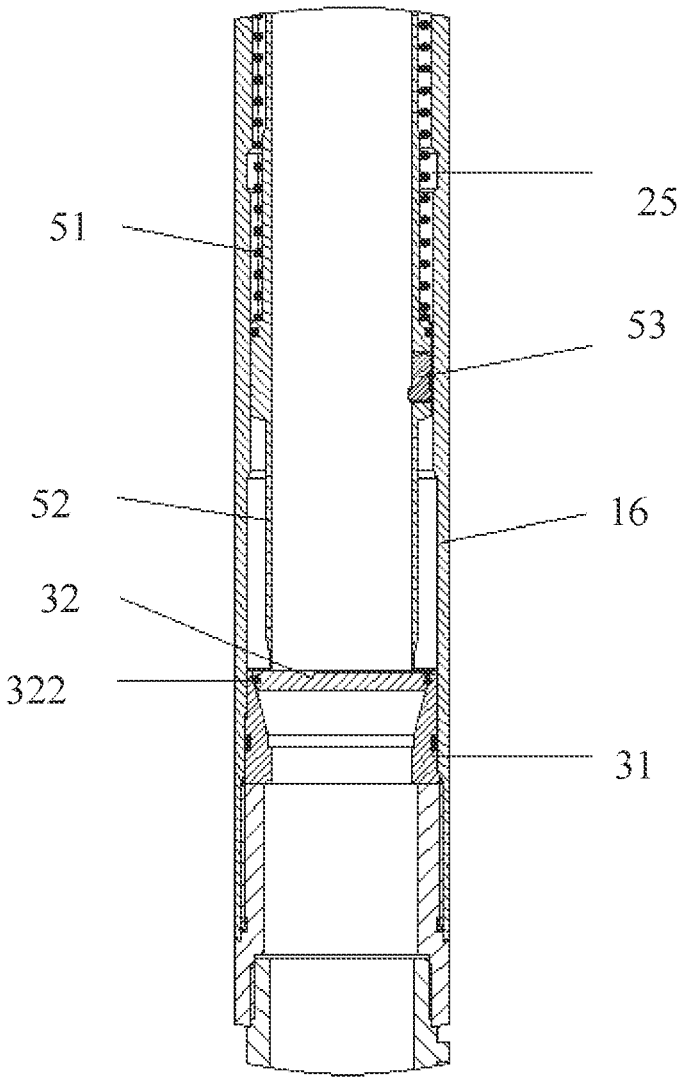
FIG. 10. An enlarged view of A in FIG. 9.

As shown in FIGS. 9 and 10, when the rock core barrel 1 is lifted up over the flap valve 3, the convex part 11 at the bottom of the rock core barrel 1 drives the trigger block 53 to rise, and then drives the trigger inner barrel 52 to rise, and then drives the trigger inner barrel 52 to compress the trigger spring 51 and rise. When the bottom of the trigger inner barrel 52 passes the sealing flap 32, the elastic sheet 242 clamped between the drilling machine outer cylinder 16 and the sealing flap 32 releases its elastic force, and the sealing flap 32 reverses under the elastic force of the elastic sheet 242 and its own gravity, and returns to the top surface of the valve seat 31, and is in sealing contact with the valve port sealing surface 311. A sealing fit is achieved with the valve seat 31. When the trigger block 53 continues to rise with the rock core barrel 1 and reaches the recessed opening 25 of the drilling machine outer cylinder 16, the trigger block 53 can be displaced radially and then separated from the role of the convex part 11 of the rock core barrel 1. When the bottom of the rock core barrel 1 passes the recessed opening 25, the trigger block 53 loses the force of the rock core barrel 1, and the trigger inner barrel 52 drives the trigger block 53 to slide down under the action of the elastic force of the trigger spring 51 and its own gravity, and finally presses on the sealing flap 32, applying the sealing-specific pressure to the sealing flap 32.

As shown in FIGS. 1-4, before the coring work starts, the rock core barrel 1 is located in the valve seat 31, the lower end of the rock core barrel 1 extends into the drill bit 4, and the lower end of the inner rod 2 extends toward the bottom of the rock core barrel 1. At this time, the sealing flap 32 opens 90°, and the tight contact between the trigger inner barrel 52 and the sealing flap 32 can restrict the rotation of the sealing flap 32.

As shown in FIGS. 5-8, as the drilling machine is lowered and runs, the rock core barrel 1 moves down with the drilling machine outer barrel 16. As the drill bit 4 is drilled, the core enters the core barrel 1 and passes through the core catcher 6. When the core gets through the hard claw 62, the claw 62 will open and thus hold it tightly. Once the first limit step 21 and the second limit step 22 are against each other, the core barrel 1 and the inner rod 2 can no longer move relative to each other in the axial direction. The inner rod 2 moves to the top dead center relative to the core barrel 1.

After stopping drilling, the inner rod 1 is pulled upwards. Because the first limit step 21 and the second limit step 22 conflict, the core tube 1 lifts up with the inner rod 1, and the claw 62 moves upward with the core tube 1. At this time, because the free end of the claw 62 is retracted, the claw 62 is difficult to be opened by the core. Because the core cannot resist larger pulling force and the free end of the claw 62 clamped inwards, the core is pulled and broken by the claw 62. The broken core will continue ascending with the core catcher 6, and thus remain in the core barrel 1. As a preference, the inner wall of the core barrel 1 has a graphene coating.

When further rising to a certain height, the trigger inner barrel 52 loses its restrictive effect on the sealing flap 32. Under the action of the spring, the sealing flap 32 returns to the top surface of the valve seat 31 and is in a sealing contact with the valve port sealing surface 311, and the valve is closed. Finally, the falling trigger inner barrel 52 presses against the sealing flap 32 and applies a sealing-specific pressure to the flap valve 3, thereby effectively avoiding the loss of liquid in the core barrel 1.

The present invention can realize the core drilling, grasping and transferring to the coring fidelity cabin through the mutual cooperation of various parts, and can complete the core drilling with high stability, high performance, and high efficiency.

Of course, there are still many other examples of the present invention. Without departing from the spirit and essence of the present invention, those skilled in the art can make various corresponding changes and deformations according to the invention, but these corresponding changes and deformations shall belong to the protection scope of the claims of the present invention.

The invention claimed is:

1. A coring device comprising a core drilling tool, a core catcher, a rock core barrel, a drilling machine outer cylinder, a flap valve, and an inner rod for pulling the rock core barrel, wherein the core catcher is disposed inside a lower end of the rock core barrel, the core drilling tool comprises an outer core tube and a hollow drill bit, an upper end of the outer core tube is connected to a lower end of the drilling machine outer cylinder, and a lower end of the outer core tube is connected to the drill bit, a lower end of the inner rod protrudes into the rock core barrel and is movable axially by relative to the rock core barrel, the flap valve comprises a valve seat and a sealing flap, the valve seat is coaxially mounted on an inner wall of the drilling machine outer cylinder, and one end of the sealing flap is movably connected to an outer sidewall of the upper end of the valve seat, a top of the valve seat is provided with a valve port sealing surface matched with the sealing flap, and when the rock core barrel is located in the valve seat, the sealing flap opens 90°; when the rock core barrel is lifted up by means of the inner rod so that the sealing flap returns to the top surface of the valve seat and is in a sealing contact with the sealing surface of the valve opening.

2. The coring device according to claim 1, wherein the core catcher comprises an annular base and a plurality of claws, the annular base is coaxially installed on the inner wall of the lower end of the rock core barrel, the plurality of claws are evenly arranged on the annular base, a lower end of each claw is connected with the annular base, and an upper end of each claw is retracted inward.

3. The coring device according to claim 2, wherein each claw comprises a vertical arm and a tilt arm, a lower end of the vertical arm is connected with the annular base, an upper end of the vertical arm is connected with a lower end of the tilt arm, an upper end of the tilt arm is a free end, and the tilt arm tilts inward from bottom to top.

4. The coring device according to claim 1, wherein the drill bit comprises an inner drill bit and an outer drill bit, the inner drill bit is installed in the outer drill bit, a lower end of the inner drill bit is provided with a first stage blade for drilling, and an outer sidewall of the outer drill bit is provided with a second stage blade for reaming.

5. The coring device according to claim 4, wherein a spiral groove is arranged on an outer wall of the outer core tube and the outer drill bit, and the spiral groove on the outer drill bit is continuous with the spiral groove on the outer core tube.

6. The coring device according to claim 4, wherein the first stage blade and the second stage blade on the drill bit are provided with coolant circuit holes.

7. The coring device according to claim 1, further comprises a trigger mechanism that comprises a trigger inner barrel and a trigger block, a side wall of the trigger inner barrel is provided with a through hole, the trigger block is placed in the through hole, and the outer sidewall of a bottom of the rock core barrel is provided with a convex part adapted to the trigger block, an inner wall of the drilling machine outer barrel is provided with a recessed opening matched with the trigger block and the trigger block is located above the sealing valve flap, and the recessed opening is located above the trigger block, when the rock core barrel is located in the valve seat, the inner trigger barrel is located between the rock core barrel and the drilling machine outer cylinder, the lower end of the inner trigger barrel is matched with a valve seat stop, the trigger block protrudes from the inner sidewall of the inner trigger barrel, and the sealing valve flap is located between the inner trigger barrel and the drilling machine outer cylinder, and when the rock core barrel is raised to a certain height, the sealing flap returns to the top surface of the valve seat and is in a sealing contact with the sealing surface of the valve opening, and the bottom of the trigger inner barrel presses on the sealing flap.

8. The coring device according to claim 7, wherein the trigger mechanism further comprises a trigger spring that is sleeved outside the trigger inner barrel, an outer wall of the trigger inner barrel is provided with a shoulder, a lower end of the trigger spring is pressed against the shoulder, and an upper end of the trigger spring is pressed against a step surface of the drilling machine outer cylinder, and the trigger spring is located above the trigger block.

9. The coring device according to claim 1, wherein the outer sidewall of a lower part of the inner rod is provided with a first limit step, while the inner sidewall of an upper part of the rock core barrel is provided with a second limit step adapted to the first limit step, when the first limit step and the second limit step are against each other, the rock core barrel and the inner rod can no longer move axially.

10. The coring device according to claim 1, wherein in a bottom of the inner rod expands, and an outer wall of an expanding part of the inner rod is provided with a sealing ring.

* * * * *